US009020401B2

(12) United States Patent
Chang et al.

(10) Patent No.: US 9,020,401 B2
(45) Date of Patent: Apr. 28, 2015

(54) APPARATUS, PRINTERS, AND CHARGE ROLLER ASSEMBLIES

(75) Inventors: Seongsik Chang, Santa Clara, CA (US); Michael H. Lee, San Jose, CA (US); Omer Gila, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/116,598

(22) PCT Filed: Jun. 7, 2011

(86) PCT No.: PCT/US2011/039482

§ 371 (c)(1),
(2), (4) Date: Nov. 8, 2013

(87) PCT Pub. No.: WO2012/170012

PCT Pub. Date: Dec. 13, 2012

(65) Prior Publication Data

US 2014/0126933 A1 May 8, 2014

(51) Int. Cl.
*G03G 15/02* (2006.01)

(52) U.S. Cl.
CPC ..... *G03G 15/0216* (2013.01)

(58) Field of Classification Search
USPC ..... 399/115, 176, 313
See application file for complete search history.

(56) References Cited

U.S. PATENT DOCUMENTS

| | | | | |
|---|---|---|---|---|
| 4,030,588 | A | 6/1977 | Hanagata et al. | |
| 5,426,488 | A | 6/1995 | Hayakawa et al. | |
| 5,499,810 | A | 3/1996 | Tranquilla | |
| 5,689,764 | A | 11/1997 | Fukuchi et al. | |
| 5,689,765 | A | 11/1997 | Nishinozono | |
| 6,381,432 | B1 | 4/2002 | Hattori | |
| 6,385,420 | B1 | 5/2002 | Morioka | |
| 6,505,013 | B1 | 1/2003 | Bedford et al. | |
| 6,665,507 | B1 | 12/2003 | Hooper, III et al. | |
| 7,575,535 | B2 | 8/2009 | Yamamoto | |
| 7,684,719 | B2 | 3/2010 | Kitajima | |
| 2005/0129426 | A1 | 6/2005 | Tsunemi et al. | |
| 2010/0104320 | A1 * | 4/2010 | Moon et al. | 399/115 |
| 2014/0126933 | A1 * | 5/2014 | Chang et al. | 399/176 |

FOREIGN PATENT DOCUMENTS

JP 2002-351285 12/2002

OTHER PUBLICATIONS

Patent Cooperation Treaty, "International Search Report and Written Opinion," issued in connection with International Patent Application Serial No. PCT/US2011/039482, mailed Jan. 6, 2012, completed Jan. 5, 2012, 10 pages.

* cited by examiner

*Primary Examiner* — W B Perkey
(74) *Attorney, Agent, or Firm* — Hanley, Flight & Zimmerman

(57) ABSTRACT

Apparatus, printers, and charge roller assemblies are disclosed. An example apparatus includes a roller to charge a printer surface when closer to the printer surface than an upper threshold, and a damper to reduce movement of the roller and to keep the roller closer to the printer surface than the upper threshold.

18 Claims, 5 Drawing Sheets

APPARATUS, PRINTERS, AND CHARGE ROLLER ASSEMBLIES

RELATED APPLICATION

This patent arises from the U.S. national stage of International Patent Application Serial No. PCT/US2011/039482, having an International Filing Date of Jun. 7, 2011, which is hereby incorporated by reference in its entirety.

BACKGROUND

Some printers use electrophotographic surfaces to accumulate ink in a pattern, which is then applied to a substrate such as printer paper to form an image. The electrophotographic surfaces have latent images "drawn" on them using a light source such as a laser. In particular, the light source selectively discharges portions of the uniform charge to form the latent images. Charge rollers are used to apply the uniform charge to the electrophotographic surface prior to drawing the latent image on the electrophotographic surface.

DETAILED DESCRIPTION

Figure 1A:
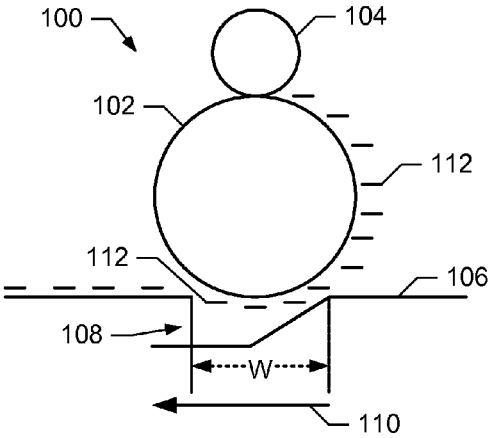
FIGS. 1A-1E illustrate a known charge roller under circumstances that can cause print defects.

Example apparatus, printers, and assemblies disclosed herein provide uniform charging to a printer surface such as an electrophotographic surface. In particular, some example apparatus, printers, and assemblies disclosed herein include a damper to keep a charging roller within an upper distance of a surface to be charged. A surface to be charged may be moved during operation which, in the absence of the damper, could cause the roller to move a distance away from the surface sufficient to cause a defect in the charge. Example dampers disclosed herein reduce movement of the roller away from the surface thereby ensuring the roller uniformly charges the surface.

Example printers disclosed herein include a surface to be charged, a roller to charge the surface, an axle and a housing to support the roller, and a damper cooperating with the axle and the housing to reduce movement of the roller due to a seam of the printer surface.

Example charge roller assemblies disclosed herein a first roller to charge a photoconductive surface in a printer, a second roller to charge the first roller, a housing to support the first roller at a first location adjacent the photoconductive surface and to support the second roller at a second location adjacent the first roller, and a compressible movement damper to reduce movement of the second roller in response to the first roller being moved by the photoconductive surface. In some example apparatus, printers, and assemblies disclosed herein, the upper threshold distance is about 7 micrometers (μm) or less. In some example apparatus, printers, and assemblies disclosed herein, a movement damper is to urge the roller into contact with the printer surface.

In some printers, a photo imaging plate or other electrophotographic surface is a foil that overlaps at a seam. When the photo imaging plate is in contact with a charge roller, the seam can cause print defects a distance from the end of the seam. The print defect is believed to be caused, in some examples, by the charge roller being moved away from the photo imaging plate for a short time, which causes a bias roller in contact with the charge roller opposite the photo imaging plate to also be moved. While in some examples the charge roller fails to charge the photo imaging plate when moved away from the photo imaging plate, the failure occurs in a region of the photo imaging plate not used for generating an image (e.g., before an region of the photo imaging plate used for printing). The bias roller can also fail to uniformly charge the charge roller when the bias roller is moved away from the charge roller. When the bias roller fails to uniformly charge the charge roller due to the movement, the section of the charge roller that is not properly charged may in turn not properly charge the photo imaging plate, thereby resulting in a print defect a distance of approximately one-half circumference of the charge roller from the seam, which falls within the print zone.

FIGS. 1A-1E illustrate a known printer 100 under circumstances that can cause print defects. The printer 100 includes a charge roller 102, a bias roller 104, and a photo imaging surface 106. The photo imaging surface 106 is constructed such that one end of the photo imaging surface 106 overlaps the other end to form a seam 108. In the printer 100, the width W of the seam 108 is sufficiently large for the charge roller 102 to at least partially enter the seam 108. In particular, the width W may be larger than, equal to, or smaller than the diameter of the charge roller 102.

FIG. 1A illustrates the printer 100 at a first time. As illustrated in FIG. 1A, the charge roller 102 is over the seam 108. Prior to entering the seam 108, the charge roller 102 is in contact with the photo imaging surface 106 and the bias roller 104 is in contact with the charge roller 102. The photo imaging surface 106 rotates in a direction 110, also causing rotation of the charge roller 102 and the bias roller 104. The bias roller 104 applies charges 112 to the external surface of the charge roller 102, which are then transferred to the photo imaging surface 106 when the surface 106 is in contact with the charge roller 102. As shown in FIG. 1A, the charge roller 102 is not in contact with the photo imaging surface 106 when the charge roller 102 is over the seam 108.

Figure 1B:
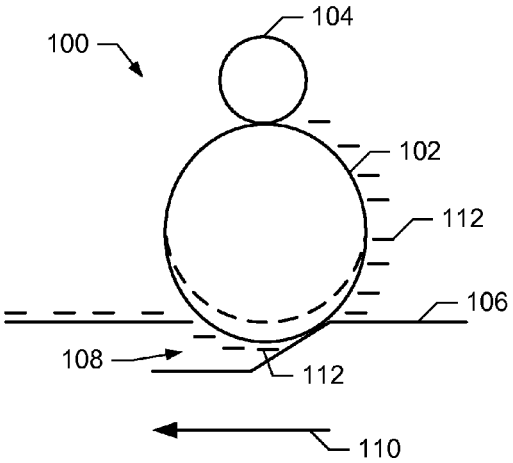

FIG. 1B illustrates the known printer 100 of FIG. 1A at a second time later than the first time. As shown in FIG. 1B, the charge roller 102 has partially entered the seam 108. In particular, the charge roller 102 is constructed using a resilient material that expands sufficiently to cause at least a portion of the charge roller 102 to enter the seam 108. The expansion of the charge roller 102 in FIG. 1B is exaggerated to illustrate the effect of the expansion. While FIG. 1A does not illustrate an expansion of the charge roller 102, the charge roller 102 may also be expanded at the first time illustrated in FIG. 1A when the charge roller 102 is over the seam 108. As the photo imaging surface 106 and the seam 108 travel in the direction 110, the charge roller 102 makes contact with the photo imaging surface 106 as shown in FIG. 1B. As shown in FIG. 1B, the charge roller 102 does not charge the photo imaging surface 106 within the seam 108 because the distance between the charge roller 102 and the photo imaging surface 106 is greater than a charging threshold distance within the seam 108.

Figure 1C:
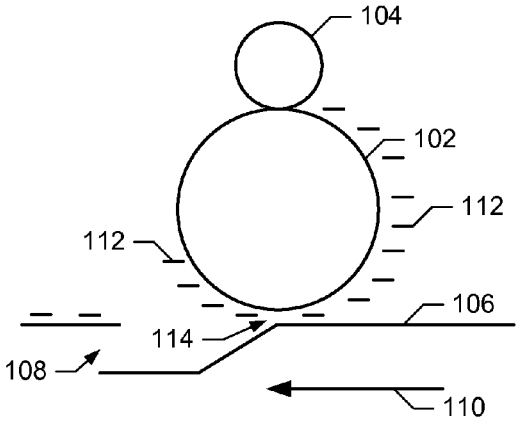

FIG. 1C illustrates the known printer 100 of FIG. 1A at a third time later than the second time. As illustrated in FIG. 1C, the photo imaging surface 106 has advanced in the direction 110 from the position illustrated in FIG. 1A, causing the seam 108 to advance past the nip formed between the photo imaging surface 106 and the charge roller 102. The contact between the charge roller 102 and a corner 114 of the photo imaging plate 102 as the charge roller 102 exits the seam 108 causes the charge roller 102 to be launched or bounced out of contact with the photo imaging surface 106. As shown in FIG. 1C, the charge roller 102 is no longer in contact with the photo imaging surface 106 and fails to charge the photo imaging surface 106, although the bias roller 104 still transfers charges 112 to the charge roller 102.

Figure 1D:
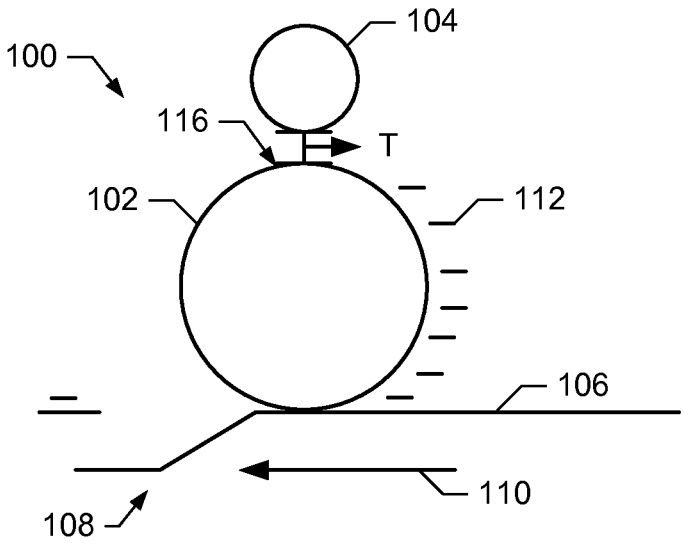
Figure 1E:
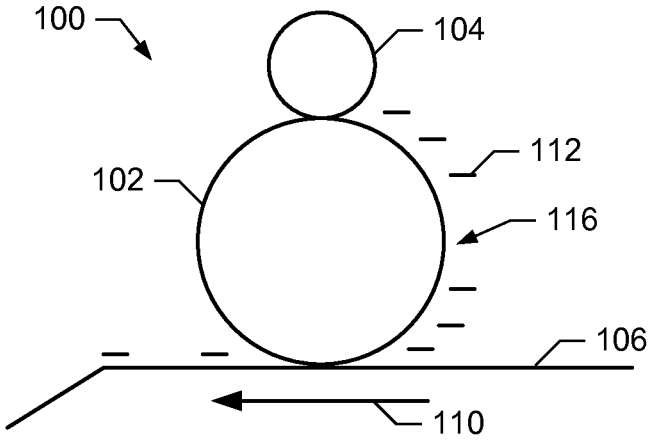

FIG. 1D illustrates the known printer 100 of FIG. 1A at a fourth time after the third time. As illustrated in FIG. 1D, at the fourth time the charge roller 102 has left contact with the bias roller 104 due to the impact from the charge roller 102 exiting the seam 108 and is more than an upper threshold distance (T) from the bias roller 104. The upper threshold distance T is the distance above which the bias roller 104 stops charging the charge roller 102. At the illustrated fourth time, the bias roller 104 is not properly charging the charge roller 102, thereby causing the charge roller 102 to have a section 116 that either has a reduced level of charge or does not have deposited charge as illustrated in FIG. 1E. When the defectively-charged section 116 rotates to be adjacent to the photo imaging surface 106, the photo imaging surface 106 is not properly charged by the section 116 and may thereby cause a print defect.

Figure 2A:
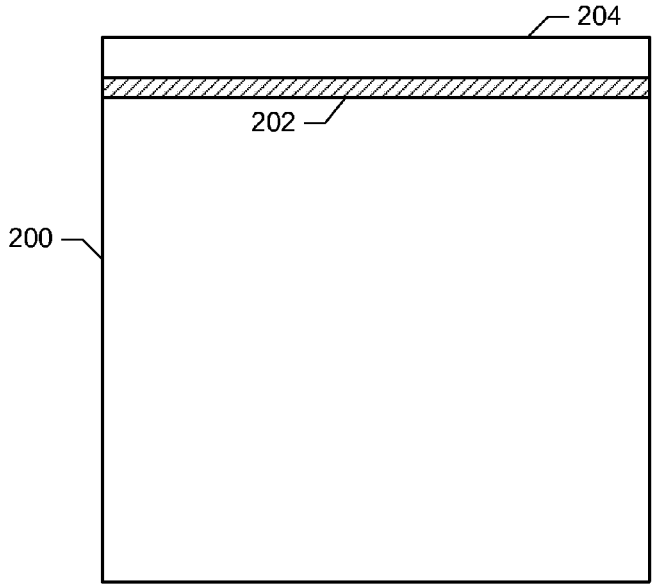
FIG. 2A illustrates a top plan view of a print substrate having an example print defect that may occur in a known printer.

FIG. 2A illustrates a top plan view of a print substrate 200 having an example print defect 202 that may occur in a known printer. For example, the known printer 100 of FIGS. 1A-1E may cause the illustrated print defect 202 during a printing operation. If the circumference of the charge roller 102 of FIGS. 1A-1E is 76 millimeters (mm) and the edge 204 of the substrate 200 corresponds to the location of the seam 108, then the location of the print defect is about 38 mm or one-half circumference of the charge roller 102 from the seam 108.

Figure 2B:
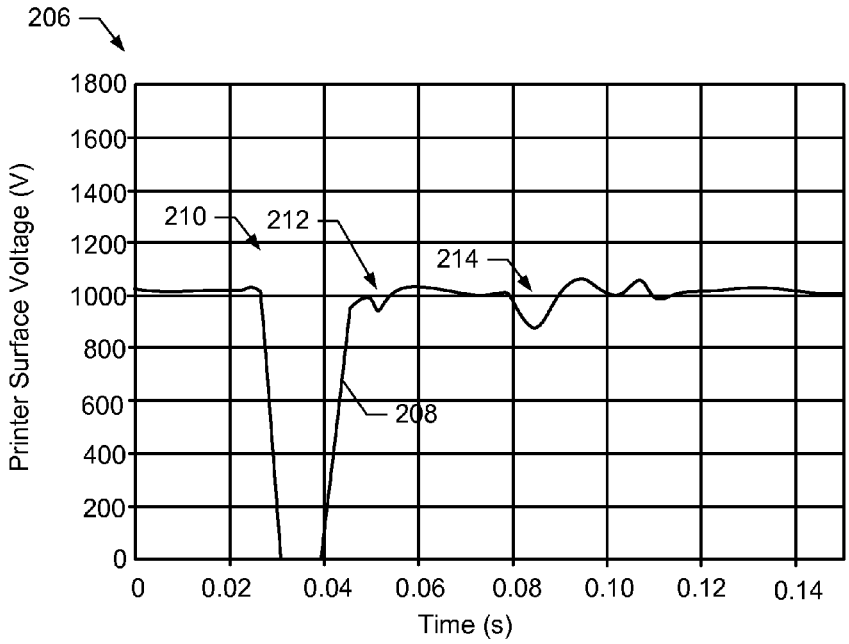
FIG. 2B is a graph illustrating example voltages occurring in a printer in association with a print defect similar to the print defect shown in FIG. 2A.

FIG. 2B is a graph 206 illustrating example voltages 208 occurring in a printer over time in association with a print defect similar to the print defect 202 illustrated in FIG. 2A. The voltage 208 is a measured voltage on the photo imaging surface 106 and was measured at a location shortly after (in the direction of rotation) the nip between the charge roller 102 and the photo imaging plate 106. In the example of FIG. 2B, the voltage 208 decreases to zero at a first time 210 corresponding to the charge roller 102 entering the seam 108. As mentioned above, the charge roller 102 does not charge the photo imaging plate 106 in the seam 108. At a second time 212, the voltage 208 fluctuates due to the charge roller 102 leaving contact with the photo imaging surface 106 after exiting the seam 108 as shown in FIG. 1C. The voltage 208 then significantly fluctuates at a third time 214 corresponding to the reduction in charge on all or a portion of the charge roller 102 when the bias roller 104 fails to charge the charge roller 102. The fluctuation at the third time 214 results in the print defect 202 illustrated in FIG. 2A and is undesirable.

Figure 3:
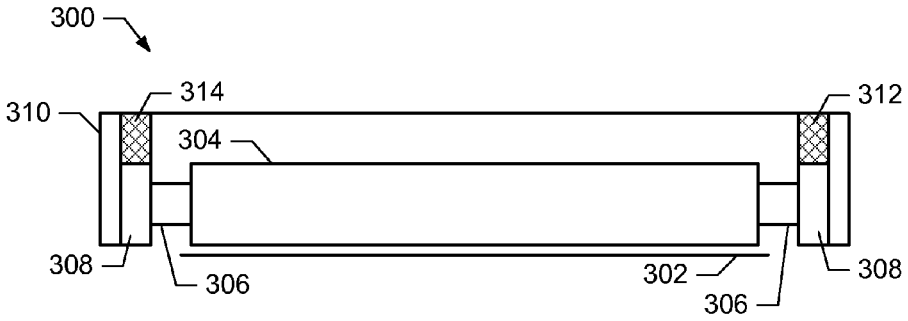
FIG. 3 illustrates an example apparatus constructed in accordance with the teachings herein to charge a print surface.

FIG. 3 illustrates an example apparatus 300 constructed in accordance with the teachings of this disclosure to charge a print surface. The example apparatus 300 of FIG. 3 may be used to implement a charge roller assembly, a printer, or any other apparatus to charge a printer surface 302. The illustrated example apparatus 300 includes a roller 304 to provide charge to the printer surface 302, an axle 306 to support the roller 304 for rotation, and a support structure 308 to journal the axle 306 and the roller 304 to a housing 310. The example roller 304 is mounted less than an upper threshold distance from the printer surface 302. If the roller 304 is more than the threshold distance from the surface 302, the roller 304 does not uniformly charge the printer surface 302. In the illustrated example, the upper threshold distance is about 7 pm or less measured in a straight line perpendicular to both the roller 304 and the printer surface 302.

As explained above, the example roller 304 may be subject to movement (e.g., in a direction away from the printer surface 302). This movement may be caused by, for example, vibration of the support structure 308, the axle 306, and/or a printer in which the apparatus 300 is installed. This movement may additionally or alternatively be caused by movement of the printer surface 302 as the surface 302 exits the seam. To reduce or prevent movement of the roller 304, the example apparatus 300 further includes compressible movement dampers 312 and 314. The example dampers 312 and 314 are constructed using a compressive, yet resilient, polyurethane foam material, although different materials may be used. Polyurethane foam dampers 312 and 314 are sufficiently dissipative to rapidly slow and/or stop movement of the roller 304 away from the print surface 302. In some examples the dampers 312 and 314 advantageously damp movement of the roller 304 or other surface, but are not so resilient as to cause bouncing or vibration in response to the movement. In some examples, pneumatic shock absorbers, hydraulic shock absorbers, hydropneumatic shock absorbers, springs, magnetic shock absorbers, and/or combinations of any of these shock absorbers may additionally or alternatively be used to implement the example dampers 312 and 314

Figure 4:
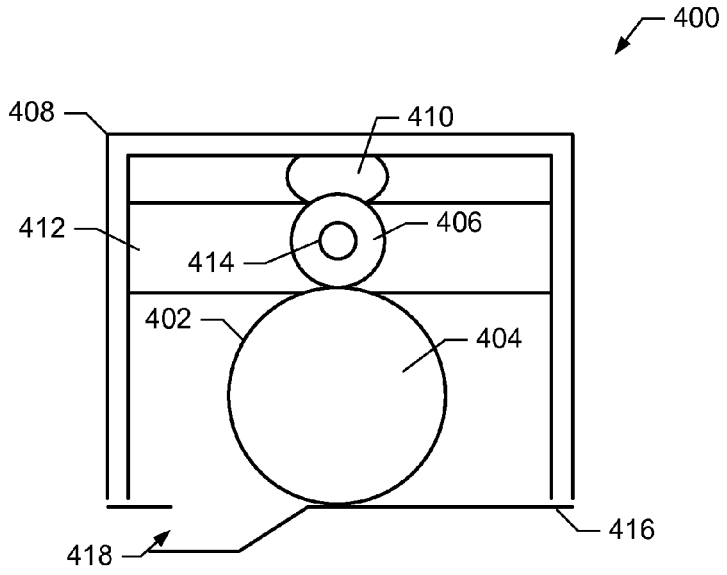
FIG. 4 illustrates an example printer, constructed in accordance with the teachings herein.

The dampers 312 and 314 are arranged in the housing 310 to resist movement of the roller 304 away from the printer surface 302 (e.g., in the upward direction as shown in FIG. 4). To avoid causing resistance to rotation of the roller 304 that could impede proper charging and/or operation of the printer surface 302, the example movement dampers 312 and 314 of FIG. 3 are placed between the housing 310 and the support structure 308. Thus, the rotatable connector between the roller 304/axle 306 and the support structure 308 is not affected by the dampers 312 and 314. The example support structure 308 allows for movement of the example roller 304 in the vertical direction of the illustrated apparatus 300.

When the example roller 304 experiences a force tending to move the roller 304 in a direction away from the printer surface 302 (e.g., due to vibration, force applied by the printer surface 302, impact on the seam 108, etc.), the axle 306 and the support structure 308 also experience that force. The force thus applies a pressure to the dampers 312 and 314 and, if sufficient, causes the movement dampers 312 and 314 to at least partially compress. The dampers 312 and 314 resist the compression and apply an opposite force to the support structure 308, which damps the movement of the support structure 308 and, by mechanical coupling, the movement of the roller 304.

FIG. 4 illustrates an example printer 400 constructed in accordance with the teachings of this disclosure. The example printer 400 of FIG. 4 includes a chargeable print surface 402 of a charge roller 404, a bias roller 406, and a housing 408. The example print surface 402 of the charge roller 404 receives charge and, in some examples, deposits the charge on another surface. In other examples, the print surface 402 is to receive the charge and does not transfer the charge to another surface. Example charge rollers and example bias rollers that may be used to implement the charge roller 404 and the bias roller 406 of FIG. 4, respectively, are disclosed in International Patent Application No. PCT/US11/23825, filed on Feb. 4, 2011, the entirety of which is hereby incorporated by reference.

The bias roller 406 illustrated in FIG. 4 advantageously applies charge to the print surface 402 substantially consistently. In the example of FIG. 4, the bias roller 406 is mounted to remain within an upper distance threshold of the print surface 402. To prevent the bias roller 406 from moving or being moved more than the upper distance from the print surface 402, the example printer 400 of FIG. 4 further includes a compressible movement damper 410. The example damper 410 of FIG. 4 is positioned between a support structure 412 and the housing 408. The support structure 412 supports the example bias roller 406 via an axle 414. In the example of FIG. 4, the print surface 402 (e.g., via the charge roller 404) applies the charge from the bias roller 406 to an electrophotographic surface 416. The example electrophotographic surface 416 of FIG. 4 includes a seam 418. As the electrophotographic surface 416 rotates during operation, the example charge roller 404 is held in place over the seam 418. Because the charge roller 404 is constructed using a resilient material, the charge roller 404 expands slightly and impacts the electrophotographic surface 416 as the charge roller 404 exits the seam 418 and causes a bounce or other movement of the print surface 402 toward the bias roller 406 (e.g., upwards as illustrated in FIG. 4).

In operation, when the example print surface 402 (e.g., via the charge roller 404) moves toward the bias roller 406 (e.g., upwards as illustrated in FIG. 4), the bias roller 406 moves in the same direction as a result of mechanical force applied to the bias roller 406 by the print surface 402. The movement of the bias roller 406 is translated to movement of the axle and the support structure 412. The movement damper 410 is compressed and applies an opposing force to the support structure 412. The damper 410 impedes and halts the movement of the support structure 412 and the bias roller 406 before the bias roller 406 moves outside the upper distance from the print surface 402. Thus, whereas in the prior art, the bias roller 406 can bounce more than the threshold distance from the print surface 402, the damper 410 damps the bounce to thereby reduce or avoid charge failures. As illustrated in FIG. 4, the example bias roller 406 is less than the upper distance from the print surface 402, including in the region after the seam 418 in which the bias roller 406 would be more than the upper distance from the print surface 402 in the absence of the damper 410. The charge roller 404 of the illustrated example may then rotate the print surface 402 to deposit or apply the charge to another surface, such as the electrophotographic surface 416 or other type of printer surface.

Figure 5:
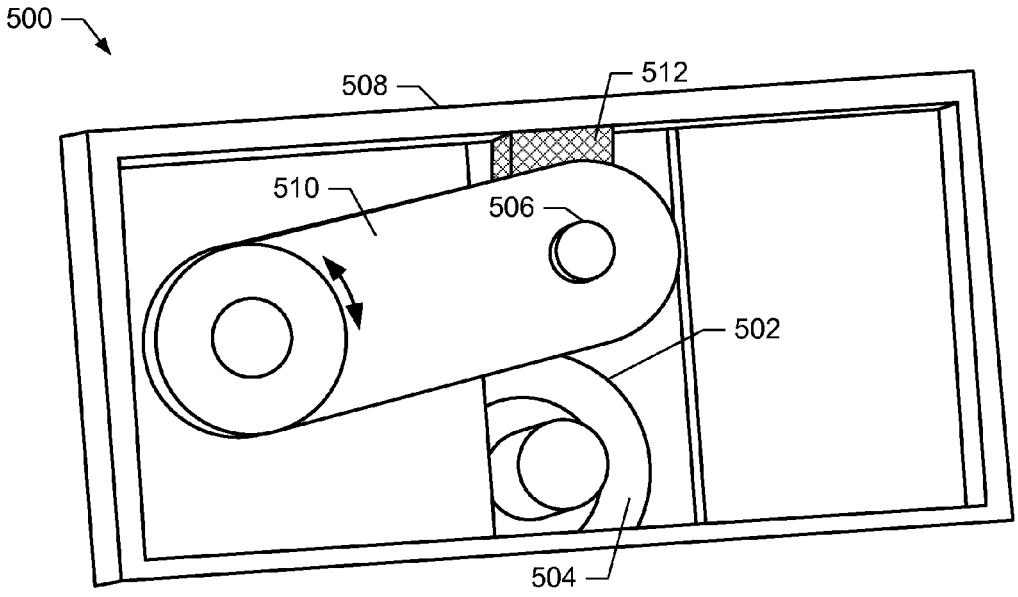
FIG. 5 illustrates an example charge roller assembly, constructed in accordance with the teachings herein.

FIG. 5 is an isometric view of an example charge roller assembly 500 to charge a print surface. The example charge roller assembly 500 of FIG. 5 includes a print surface 502 on a charge roller 504, a bias roller (obscured) on an axle 506, a housing 508, and a pivoting support arm 510 to support the axle 506. Like the example apparatus 300 of FIG. 3 and the example printer 400 of FIG. 4, the illustrated example assembly 500 of FIG. 5 advantageously applies charge to the print surface 502 substantially consistently. The example charge roller assembly 500 of FIG. 5 is an alternative configuration to the example apparatus 300 and/or the example printer 400 of FIGS. 3 and 4 to charge a print surface.

The example support arm 510 of FIG. 5 allows movement of the bias roller axle 506 and the attached bias roller toward and away from the example print surface 502. While not illustrated in FIG. 5, the example charge roller 504 and the print surface 502 may also be mechanically coupled to a support arm to permit movement. To prevent the bias roller from moving more than an upper threshold from the print surface 502, the example charge roller assembly 500 of FIG. 5 further includes a damper 512. The example damper 512 of FIG. 5 is a resilient, compressible material such as polyurethane placed between the support arm 510 and the housing 508.

To install the example damper 512, the damper 512 is compressed from an initial size and placed between the support arm 510 and the housing 508 as illustrated in FIG. 5. When released, the example damper 512 decompresses to fill the space between the support arm 510 and the housing 508. In the illustrated example, the damper 512 exerts force on both the support arm 510 and the housing 508, which causes sufficient friction to keep the damper 512 in position. However, in some examples the damper 512 may be attached and/or adhered to one or both of the support arm 510 or the housing 508. Other configurations of the housing 508, the support arm 510, and/or the movement damper 512 may have different installation procedures.

Figure 6:
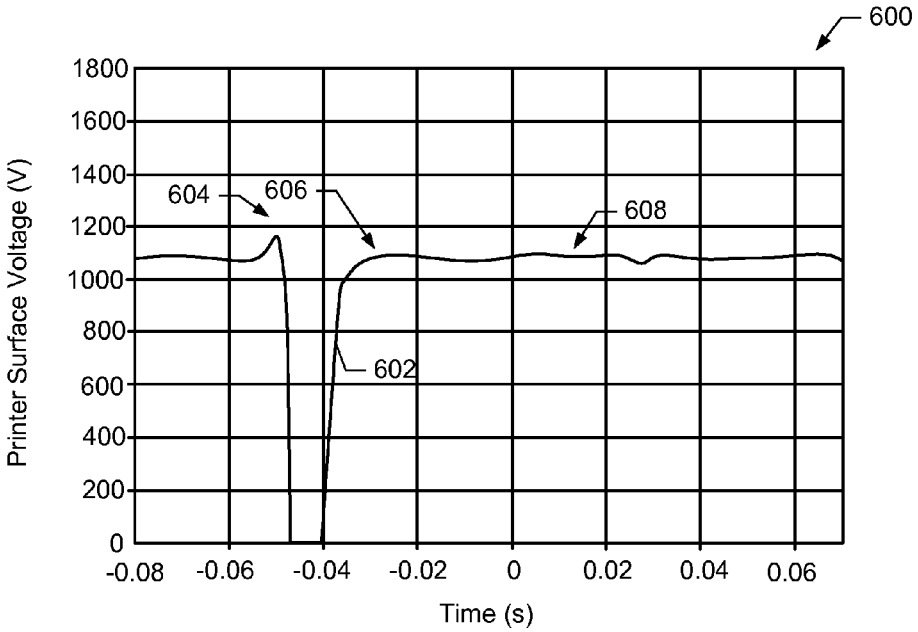
FIG. 6 is a graph illustrating example voltages occurring in a printer including the example apparatus of FIGS. 3, 4, and 5.

FIG. 6 is a graph 600 illustrating an example voltage 602 occurring in an example printer including an apparatus similar to the apparatus 300 FIG. 3 and/or the charge roller assembly 500 of FIG. 5. The example voltage 602 is a voltage on the photo imaging surface (e.g., the example photo imaging plate 316 of FIG. 3) measured at a location shortly after (in the direction of rotation) the nip between a charge roller (e.g., the charge roller 304 and the photo imaging plate 316).

The example voltage 602 illustrated in FIG. 6 decreases substantially to zero at a first time 604 corresponding to the charge roller 304 entering a seam (e.g., the seam 418) in the example electrophotographic surface 416. The example charge roller 304 does not charge the electrophotographic surface 416 in the seam 418. As described above, the subsequent contact between the charge roller 404 and the electrophotographic surface 416 as the charge roller 404 exits the seam 418 causes the charge roller 404 to be moved toward the bias roller 406 which, in turn, can cause the bias roller 406 to bounce. While the voltage 602 at the first time 604 is a substantial variation, the example first time 604 corresponds to a portion of the electrophotographic surface 416 that is not used for printing (e.g., a space between sheets of print substrate, etc.). However, unlike the voltage 208 of FIG. 2, the voltage 602 of FIG. 6 does not fluctuate at a second time 606 (corresponding to the second time 212 of FIG. 2B) or at a third time 608 (corresponding to the third time 214 of FIG. 2B). It is believed that the voltage 602 of FIG. 6 does not fluctuate at the second time 606 because the movement damper 410 and the bias roller 406 maintains the charge roller 404 in contact with and/or within an upper charging distance of the electrophotographic surface 416. Additionally, the voltage 602 of FIG. 6 does not fluctuate at the third time 608 because the example movement damper 410 of FIG. 4 maintains the bias roller 406 within an upper threshold distance of the printer surface 402. As a result, the printer surface 402 is substantially consistently charged in the regions used for printing on a print substrate, and the printer surface 402 charges the electrophotographic surface 416 as illustrated at the third time 608.

Example apparatus, printers, and/or charge roller assemblies disclosed herein may be used to damp movement of one or more rollers that provide charge to printer surfaces. In some examples, apparatus, printers, and/or charge roller assemblies disclosed herein are used to provide charge from a bias roller to a charge roller and/or to a photo imaging plate without suffering from print defects due to bounces or other movements of the charge roller and/or the bias roller. In some examples, the compressible movement damper reduces vibrations of the roller and maintains the roller within an upper threshold distance of the printer surface to thereby improve charging consistency.

Although certain example apparatus, printers, and charge roller assemblies have been described herein, the scope of coverage of this patent is not limited thereto. On the contrary, this patent covers all apparatus, printers, and charge roller assemblies fairly falling within the scope of the claims of this patent.

What is claimed is:

1. An apparatus, comprising:

a first roller to charge a printer surface when the first roller is less than a first upper threshold distance away from the printer surface;

a second roller to charge the first roller when the second roller is less than a second upper threshold distance away from the first roller; and a damper to reduce movement of the first and second rollers to keep the second roller within the second upper threshold of the first roller and to keep the first roller within the first upper threshold of the printer surface.

2. An apparatus as defined in claim 1, wherein the damper comprises at least one of a polyurethane foam member, a pneumatic shock absorber, a hydraulic shock absorber, a hydropneumatic shock absorber, a spring, or a magnetic shock absorber.

3. An apparatus as defined in claim 1, wherein the first roller is to contact the printer surface.

4. An apparatus as defined in claim 3, wherein the damper is to keep the first roller in contact with the printer surface.

5. An apparatus as defined in claim 1, further comprising a housing and an axle rotatably mounted to the housing, the damper positioned between the axle and the housing.

6. An apparatus as defined in claim 1, wherein the damper is to reduce a disruption in charging of the printer surface by the first roller.

7. An apparatus as defined in claim 1, wherein the damper is to reduce movement of the first roller caused by a seam of the printer surface.

8. A printer, comprising:

a surface to be charged;

a first roller to charge the surface;

a second roller to charge the first roller;

an axle and a housing to support the second roller; and a damper cooperating with the axle and the housing to reduce movement of the second roller relative to the first roller due to a seam of the surface.

9. A printer as defined in claim 8, wherein the first roller is to contact the surface and the damper, via the second roller, is to keep the first roller in contact with the surface.

10. A printer as defined in claim 9, wherein the damper is to reduce a distance that the first roller moves relative to the surface.

11. A printer as defined in claim 8, wherein the damper comprises at least one of a polyurethane foam member, a pneumatic shock absorber, a hydraulic shock absorber, a hydropneumatic shock absorber, a spring, or a magnetic shock absorber.

12. A printer as defined in claim 8, wherein the damper is positioned to allow the second roller to rotate.

13. A charge roller assembly, comprising:

a first roller to charge a photoconductive surface in a printer;

a second roller to charge the first roller;

a housing to support the first roller at a first location adjacent the photoconductive surface and to support the second roller at a second location adjacent the first roller; and a compressible movement damper to reduce relative movement between the first roller and the second roller in response to the first roller being moved by the photoconductive surface.

14. A charge roller assembly as defined in claim 13, wherein the movement damper is to keep the second roller within an upper distance to the first roller.

15. A charge roller assembly as defined in claim 14, wherein the upper distance is less than about 7 micrometers.

16. An apparatus as defined in claim 1, wherein the damper comprises polyurethane foam.

17. An apparatus as defined in claim 1, wherein the damper is to bias the second roller towards the first roller.

18. An apparatus as defined in claim 1, further comprising a pivoting support arm to support an axle of the second roller and to enable movement of the second roller relative to the first roller.

* * * * *